US008567378B2

(12) United States Patent
Nugent

(10) Patent No.: US 8,567,378 B2
(45) Date of Patent: Oct. 29, 2013

(54) AIR PATH AND SAFETY VALVE SYSTEM FOR TOY LAUNCHERS

(75) Inventor: David Michael Nugent, Newport, RI (US)

(73) Assignee: Habro, Inc., Pawtucket, RI (US)

( * ) Notice: Subject to any disclaimer, the term of this patent is extended or adjusted under 35 U.S.C. 154(b) by 114 days.

(21) Appl. No.: 13/420,855

(22) Filed: Mar. 15, 2012

(65) Prior Publication Data

US 2013/0239938 A1 Sep. 19, 2013

(51) Int. Cl.
*F41B 11/00* (2013.01)

(52) U.S. Cl.
USPC ..... 124/59; 124/56; 124/73

(58) Field of Classification Search
USPC ..... 124/56, 59, 63–66, 69–70, 73
See application file for complete search history.

(56) References Cited

U.S. PATENT DOCUMENTS

| | | | | | |
|---|---|---|---|---|---|
| 961,511 | A | | 6/1910 | Marble | |
| 1,374,757 | A | | 4/1921 | Napier | |
| 1,441,975 | A | | 1/1923 | Edelin | |
| 2,109,589 | A | | 3/1938 | Horwitt et al. | |
| 2,530,805 | A | * | 11/1950 | Bond | 175/4.58 |
| 3,025,633 | A | * | 3/1962 | Kaye et al. | 446/212 |
| 3,724,438 | A | * | 4/1973 | Brandt | 124/59 |
| 3,756,284 | A | * | 9/1973 | Breunich | 137/636 |
| 3,968,783 | A | | 7/1976 | Pfotenhauer | |
| 4,004,566 | A | * | 1/1977 | Fischer | 124/59 |
| 4,170,215 | A | | 10/1979 | Kettlestrings | |
| 4,248,202 | A | | 2/1981 | Jaworski et al. | |
| 4,659,320 | A | | 4/1987 | Rich et al. | |
| 5,267,549 | A | | 12/1993 | Webber | |
| 5,292,134 | A | | 3/1994 | Schlundt et al. | |
| 5,343,850 | A | | 9/1994 | Steer | |
| 5,373,833 | A | | 12/1994 | D'Andrade | |
| 5,377,656 | A | | 1/1995 | Lewinski et al. | |
| 5,433,646 | A | | 7/1995 | Tarng | |
| 5,471,967 | A | | 12/1995 | Matsuzaki et al. | |
| 5,476,087 | A | | 12/1995 | Kunimoto | |
| 5,515,837 | A | | 5/1996 | Nin et al. | |
| 5,529,050 | A | | 6/1996 | D'Andrade | |
| 5,535,729 | A | | 7/1996 | Griffin et al. | |
| 5,605,140 | A | | 2/1997 | Griffin | |

(Continued)

OTHER PUBLICATIONS

PCT/US2013/030602—International Search Report. dated May 21, 2013.

(Continued)

*Primary Examiner* — Daniel J Troy
*Assistant Examiner* — Benjamin Gomberg
(74) *Attorney, Agent, or Firm* — Perry Hoffman

(57) ABSTRACT

An air path and improved safety valve combination for toy air guns including a housing in the shape of a gun, multiple barrels mounted to the housing, a piston, cylinder and spring combination for generating blasts of compressed air mounted to the housing, an air passageway structure with an air path channel mounted in the housing, and multiple valve elements movable in the air path channel between open rearward positions and closed forward positions. When in the rearward position, each valve element directs a blast of compressed air to an associated barrel because the barrel is loaded with a soft foam dart of proper shape. When the valve element is in a forward position indicating an empty barrel, the valve element causes the blasts of compressed air to cascade to the next valve element of a dart-loaded barrel in sequence and in a very efficient manner.

20 Claims, 7 Drawing Sheets

(56) References Cited

U.S. PATENT DOCUMENTS

| | | | | |
|---|---|---|---|---|
| 5,611,322 | A | 3/1997 | Matsuzaki et al. | |
| 5,711,285 | A | 1/1998 | Stewart et al. | |
| 5,878,734 | A | 3/1999 | Johnson et al. | |
| 5,996,564 | A | 12/1999 | Kotowski | |
| 6,119,671 | A * | 9/2000 | Smith et al. | 124/59 |
| 6,224,457 | B1 | 5/2001 | Wu | |
| 6,279,562 | B1 | 8/2001 | Clayton | |
| 6,598,329 | B1 | 7/2003 | Alexander | |
| 6,733,356 | B2 | 5/2004 | Lee | |
| 7,287,526 | B1 | 10/2007 | Bligh et al. | |
| 7,418,797 | B1 | 9/2008 | Crose | |
| 7,437,847 | B1 | 10/2008 | Mabry | |
| 7,481,209 | B1 | 1/2009 | Bligh et al. | |
| 7,537,001 | B2 * | 5/2009 | Ma | 124/69 |
| 7,552,557 | B1 | 6/2009 | Mabry | |
| 7,673,624 | B2 | 3/2010 | Rosella, Jr. | |
| 2006/0242880 | A1 | 11/2006 | Griffin | |
| 2011/0146645 | A1 | 6/2011 | Ma | |
| 2011/0168150 | A1 | 7/2011 | Fan et al. | |

OTHER PUBLICATIONS

PCT/US2013/030602—Written Opinion of the International Searching Authority. dated May 21, 2013.

PCT/US2013/030602—Notification of Transmittal of the International Search Report and the Written Opinion of the International Searching Authority or the Declaration. May 21, 2013.

* cited by examiner

AIR PATH AND SAFETY VALVE SYSTEM FOR TOY LAUNCHERS

FIELD OF THE INVENTION

The present invention relates generally to an air path and safety valve system for toy launchers, such as toy air guns, and, more particularly, to an air path and safety valve apparatus that makes more efficient use of compressed air generated by the toy launcher, and provides for sequential bypasses of launch sites by the compressed air.

BACKGROUND OF THE INVENTION

Toys and other devices that discharge projectiles by release of a compressed or stretched spring or other means to compress air are well known and are disclosed in several existing patents. Earlier patents disclose variations of different valves while later patents disclose safety valves in toy launchers and air guns. By way of example, U.S. Pat. No. 1,441,975, for a "Pneumatic Toy Pistol" issued in 1923 to Edelin purports to disclose an air gun where compressed air is created by a piston being driven in a cylinder by a compressed spring, and includes a valve and a BB-like projectile in a barrel. The valve includes a first stationary tube having an opening, the first tube being located at the top end of the cylinder, and a second tube slidable in the first tube and also having an opening. The opening in the second tube is misaligned with the opening in the first tube when the valve is closed and the two openings are aligned when the valve is open. Alignment of the openings is accomplished when a nut located at the top of the piston engages a spring biased pin attached to the second tube. Typically, the valve is biased closed. Engagement occurs when the piston reaches the end of its upward movement in the cylinder such that the open valve allows a blast of compressed air from the cylinder to exit through the valve, impinge on the projectile and cause its discharge. U.S. Pat. No. 5,343,850 for a "Double Shot Projectile Launcher" issued in 1994 to Steer purports to disclose a double barrel launcher using a bellows for generating a blast of compressed air. The path of the compressed air is determined by manipulation of a trigger that operates a slide valve. The slide valve aligns openings to clear an air path to one of two projectile supporting launch tubes. When the slide valve misaligns the openings to the launch tube, the air path is blocked.

U.S. Pat. No. 5,373,833, issued to D'Andrade, also in 1994, for a "Projectile Shooting Air Gun With Bladder" purports to disclose an air gun with a pump and bladder combination to generate a blast of compressed air and a chamber surrounding a spring biased valve. A trigger pulls a flat faced valve element away from a valve seat to release the compressed air to a barrel having a soft foam dart where the dart is placed over a launch tube, an early attempt at a safety feature. Another patent, U.S. Pat. No. 5,476,087, issued in 1995 and entitled "Model Gun With Automatic Bullet Supplying Mechanism" also uses a simple spring biased valve to communicate a source of compressed air with a projectile.

A safety valve appears in a patent issued to Nin and D'Andrade, U.S. Pat. No. 5,515,837, granted in 1996, and entitled "Safety Nozzle For Multi-Shot Projectile Shooting Air Gun," and in U.S. Pat. No. 5,529,050, issued in 1996 to D'Andrade entitled "Safety Nozzle For Projectile Shooting Air Gun." The '837 and '050 patents purport to describe a toy air gun safety valve for firing soft foam darts where the valve does not open unless the dart inserted into a launch tube has a predetermined shape that matches a configuration of the valve to enable the dart to push the valve to an open position. The '837 patent also discloses a revolving launch tube magazine, a series of spring biased pins on the magazine with one pin besides each of the launch tubes, a second valve in the form of a hinged flap, and a trigger. Pulling the trigger discharges a dart and rotates the magazine to align another tube of the magazine in front of a pressurized air tank. When the magazine revolves, a spring biased pin on the magazine next to the tube extends outward to swing the hinged flap from a closed position to an open position whether or not the launch tube is loaded. Compressed air generated by the air gun passes through the second valve and then through the safety valve in an axial direction. Also in 1996, a U.S. patent issued to Griffin and Boyle, U.S. Pat. No. 5,535,729, entitled "Projectile Launcher" that purports to disclose an air gun having a fixed plurality of launch tubes and a rotatable cylinder and piston for directing a blast of compressed air to a distribution manifold which directs the air to each of the launching tubes sequentially whether loaded or not. The compressed air is first directed axially from the piston, then radially in one of the distribution passages, and finally axially to the aligned launch tube.

Two more recent patents to Bligh, Mead and Brown, U.S. Pat. No. 7,287,526 and U.S. Pat. No. 7,481,209, both entitled "Toy Projectile Launcher With Slidable Outer Cylinder and Stationary Inner Compression Member," the later patent being a divisional of the earlier patent, purport to disclose a safety valve for an air gun. Moving a slide generates a blast of compressed air and, once actuated, the air flows to the valve in an axial direction. A published U.S. Application, No. 2011/0146645, for a "Toy Air Gun" listing Chor-Ming Ma as inventor, purports to disclose a fixed multiple barrel device with a piston and cylinder arrangement, a pressure chamber at the front end of the piston and cylinder arrangement, and a rotatable disc in the pressure chamber with a single port that is indexed with each discharge to move to a next barrel. Compressed air created by the piston enters the pressure chamber and exits axially through the single port.

These patents and application and the devices disclosed are of some interest, however, they do not teach an efficient safety valve with cascading capability.

SUMMARY OF THE INVENTION

In accordance with the present invention, an advantageous method and several apparatus are described in the form of a novel air path and an improved safety valve for cascading a blast of compressed air in a toy air gun. The compressed air moves in a succession of stages from one launch site to another to locate the next loaded launch site based upon the positions of the safety valves. After discharge of a projectile from a multi-barrel air gun, for example, the gun may be cocked and immediately fired again because the air path for a blast of compressed air in the toy gun is able to bypass barrels from which projectiles have already been discharged so that the compressed air flows to the next loaded barrel. Barrels may even be randomly loaded and the blast of compressed air will flow to the first loaded barrel, skipping intervening empty barrels. The improved safety valves disclosed in detail here allow the blasts of compressed air to enter laterally and is more efficient. The apparatus is also simply constructed, structurally robust, compact, automatically operated and relatively inexpensive.

Briefly summarized, the invention relates to an air path and safety valve system for a toy launcher including a plurality of launch sites, each launch site being loadable with a projectile to be discharged, an air passageway structure operatively connected in series to each of the plurality of launch sites to enable communication of a source of compressed air to each of the plurality of launch sites, a plurality of valve elements, each valve element associated with a launch site of the plurality of launch sites and being movable between two positions, a rearward position to enable compressed air to cause discharge of a loaded projectile from the launch site and a forward position to enable compressed air to bypass the launch site, the air passageway structure and the plurality of valve elements enabling a blast of compressed air to cascade from one or more unloaded launch sites to a loaded launch site, and a plurality of springs, each spring associated with a valve element of the plurality of valve elements for biasing the valve element from the rearward position to the forward position, and wherein loading a projectile in a launch site causes the valve element to move from the forward position to the rearward position.

The invention also relates to a method for making a toy air gun including the steps of forming a housing, mounting multiple projectile barrels to the housing, mounting an air passageway structure in operative communication with the barrels, the air passageway structure having a fixed air path channel and multiple chambers, forming multiple valve elements, each valve element having a front section with a configuration for engaging projectiles having a predetermined shape and a side opening for receiving a blast of compressed air, a rear section with side and rear openings, and a non-perforated wall separating the front section from the rear section, mounting each of the multiple valve elements to a chamber in the air path channel of the air passageway structure such that each valve element is movable longitudinally between forward and rearward positions and each of the multiple valve elements is able to receive a blast of compressed air in a direction lateral to the direction of movement of the valve element, and inserting multiple springs in the air passageway structure, each spring for biasing an associated valve element in a forward direction.

BRIEF DESCRIPTION OF THE DRAWINGS

For the purpose of facilitating an understanding of the invention, the accompanying drawings and detailed description illustrate embodiments thereof, from which the structures, construction and operation, processes, and many related advantages of the embodiments may be readily understood and appreciated.

DESCRIPTION OF THE EMBODIMENTS

The following description is provided to enable those skilled in the art to make and use the described embodiments set forth. Various modifications, equivalents, variations, and alternatives, however, will be readily apparent to those skilled in the art. Any and all such modifications, variations, equivalents, and alternatives are intended to fall within the spirit and scope of the present invention defined by the below listed claims.

Figure 1:
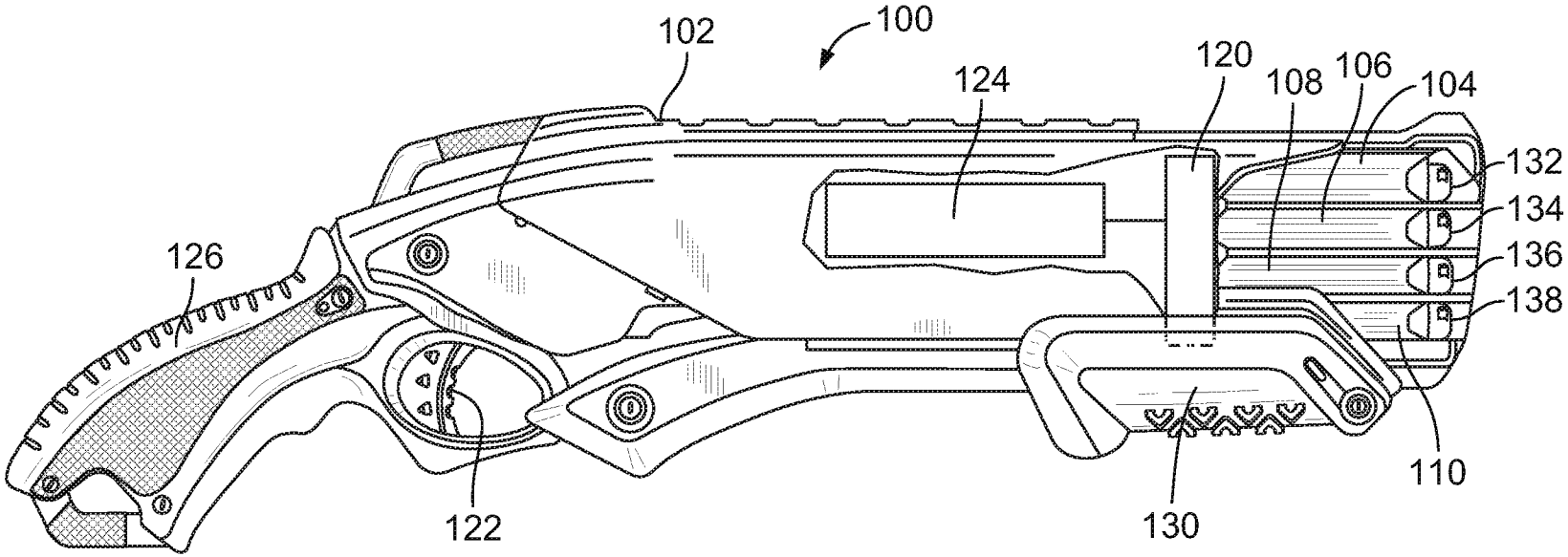
FIG. 1 is a diagrammatic side elevation view, partially broken away, of an embodiment of a toy gun apparatus with eight barrels having the inventive air passageway structure and improved safety valves.
Figure 2:
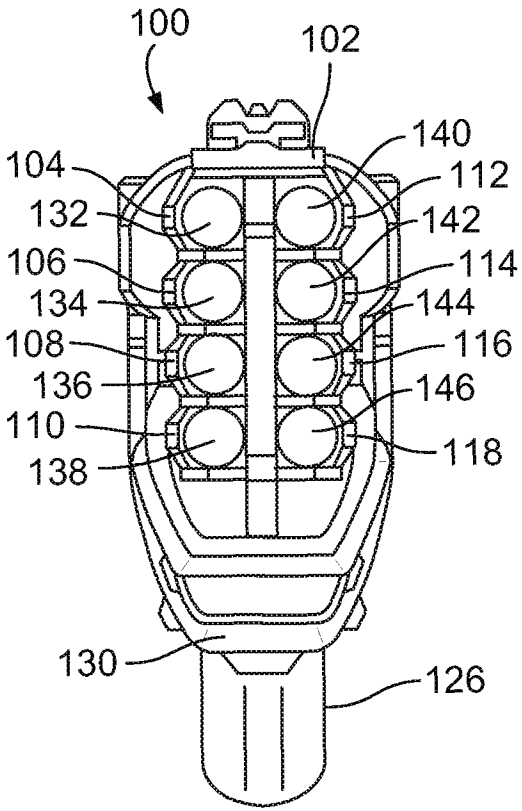
FIG. 2 is a diagrammatic enlarged front elevation view of the toy gun apparatus illustrated in FIG. 1.
Figure 11:
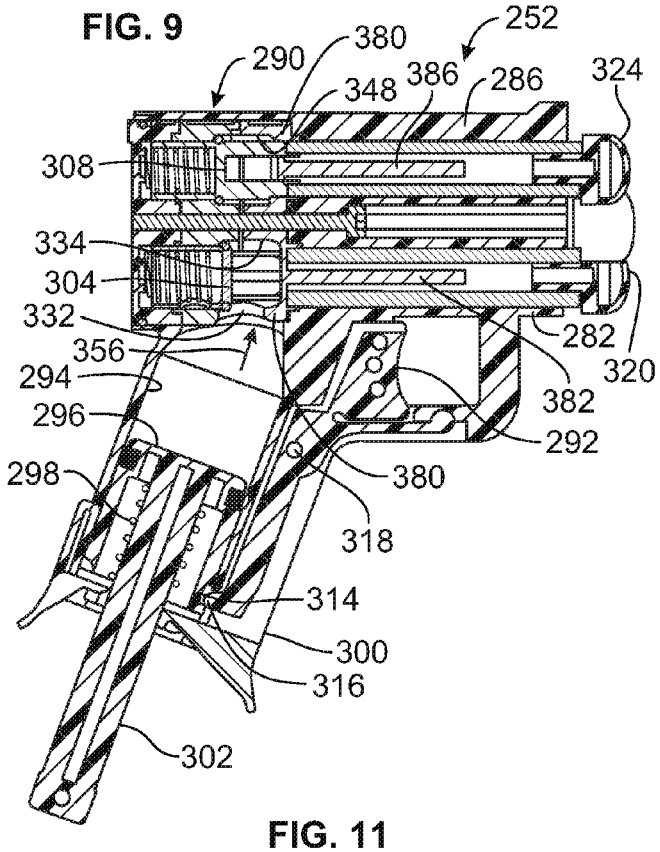
FIG. 11 is a diagrammatic section view taken along line 11-11 of FIG. 10.
Figure 12:
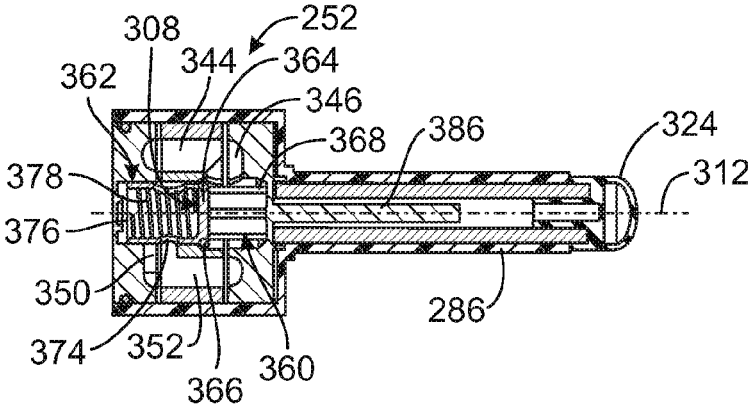
FIG. 12 is a diagrammatic section view taken along line 12-12 of FIG. 10.

Referring now to FIGS. 1 and 2, a toy air gun 100 is illustrated. The air gun includes a housing 102, a plurality or multiplicity of launch sites in the form of eight barrels 104, 106, 108, 110, 112, 114, 116, 118 in two aligned configurations of four barrels each, two parallel disposed air passageway structures, of which only one air passageway structure 120 is shown, each air passageway structure operatively connected to one of the two four-aligned barrel configurations, a trigger 122, two compressed air sources, of which only one compressed air source 124 is shown, each compressed air source in communication with one of the air passageway structures and from there to one of the aligned barrel configurations, and a grip 126. The compressed air source may take any one of a number of forms as indicated by the above-mentioned patents. A common compressed air source is a piston moving in a cylinder driven by a spring as shown here in FIG. 11, just by way of example. A pump-action slide 130 mounted to a lower portion of the housing 102 is used to cock the air gun by compressing the driving spring. The air gun barrels are shown loaded with projectiles, such as darts 132, 134, 136, 138, 140, 142, 144, 146 made of NERF™ brand foam, a solid, spongy cellular material.

The toy air gun 100 has the capability to discharge darts from all eight barrels, two at a time after cocking the air gun before each discharge, because of the operative cooperation of the air passageway structures and improved safety valves that are described below. Compressed air is directed automatically in the air passageway structure, in that no action is required from the user, and an air path channel in the air passageway structure is fixed, with no moving parts, from one loaded barrel to the next loaded barrel. Empty barrels are skipped or bypassed. This cascading of blasts of compressed air allows rapid firing of multi-barrel air guns, a major advantage of the present invention. No magazine, cartridge, cassette or canister containing multiple darts is required, although these may be used with slight modification of the various air gun embodiments mentioned here.

Figure 3:
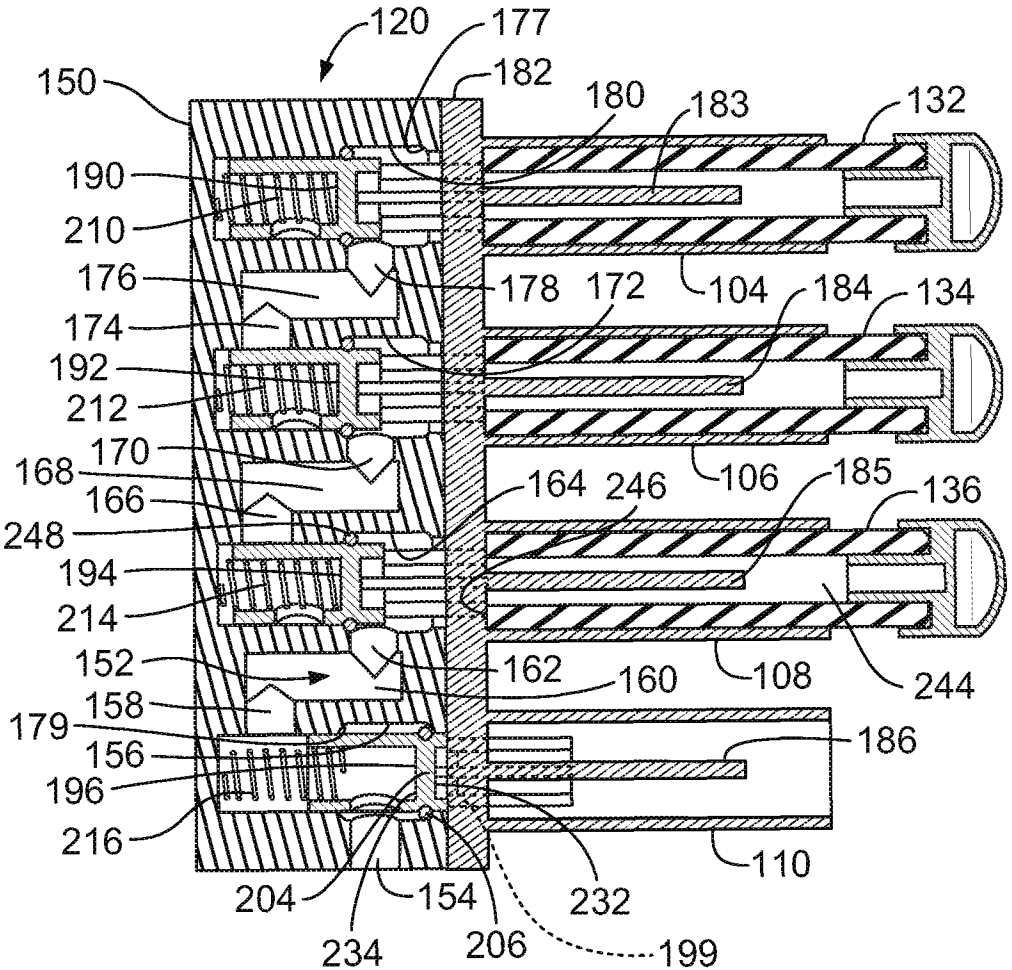
FIG. 3 is a diagrammatic enlarged section view of the air passageway structure formed as a block with an air path channel and four valve elements mounted in the channel.

Each air passageway structure, such as the air passageway structure 120, may include a block 150, FIG. 3, with a fixed air path channel 152. The block is operatively connected to the barrels 104, 106, 108, 110, aligned in a linear configuration. The air passageway structure is extremely flexible so that many different barrel arrangements may be configured, such as a circular, somewhat cylindrical, triple barrel arrangement shown in FIG. 8, or a quadruple circular arrangement shown in FIGS. 9-15. Referring now to FIG. 3, the fixed air path channel 152, starts with a first air inlet 154, a first valve element chamber 156, a first air outlet 158, and a first transfer tube 160, the first transfer tube communicating with a second air inlet 162, a second valve element chamber 164, a second air outlet 166, and a second transfer tube 168. The second transfer tube 168 communicates with a third air inlet 170 and from the third air inlet 170 to a third valve element chamber 172, a third air outlet 174, a third transfer tube 176, a fourth air inlet 178, and a fourth valve element chamber 180. The valve element chambers form valve seats for the valve elements, such as a front valve seat 177 in the chamber 180 and a rear valve seat 179 in the chamber 156, as the valve elements move between forward and rearward positions. The number of chambers visited by a blast of compressed air may be more or less than the four shown here. Mounted between the barrels 104, 106, 108, 110 and the block 150 is a spike plate 182 that includes four spikes or posts 183, 184, 185, 186 extending into the barrels 104, 106, 108, 110, respectively. The spike plate, the barrels and the spikes may be made as a single integral structure as shown.

Figure 14:
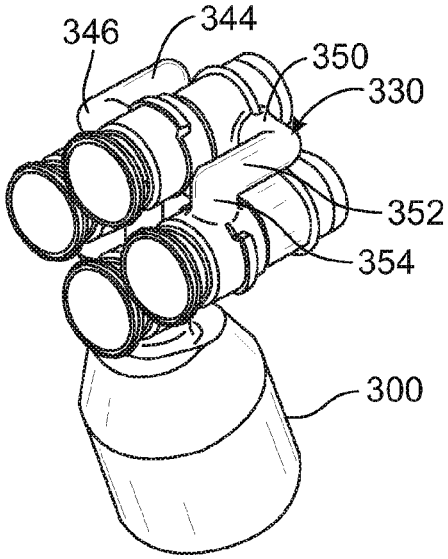
FIG. 14 is a diagrammatic isometric view of an upper end of a cylinder and a circular air passageway structure.
Figure 15:
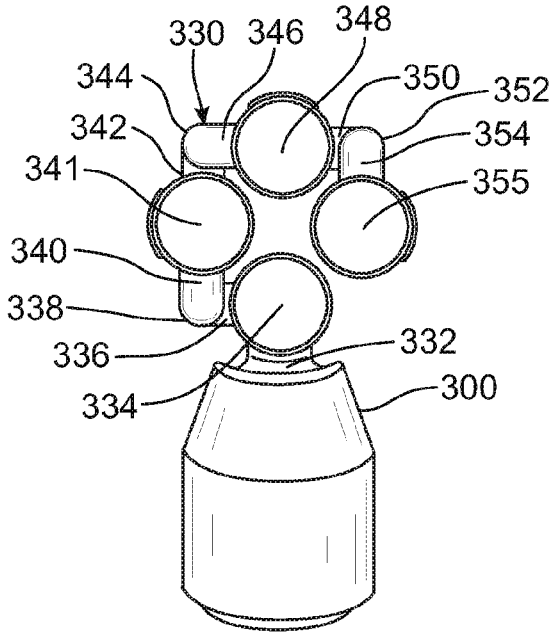
FIG. 15 is a diagrammatic front elevation view of the apparatus shown in FIG. 14.
Figure 16:
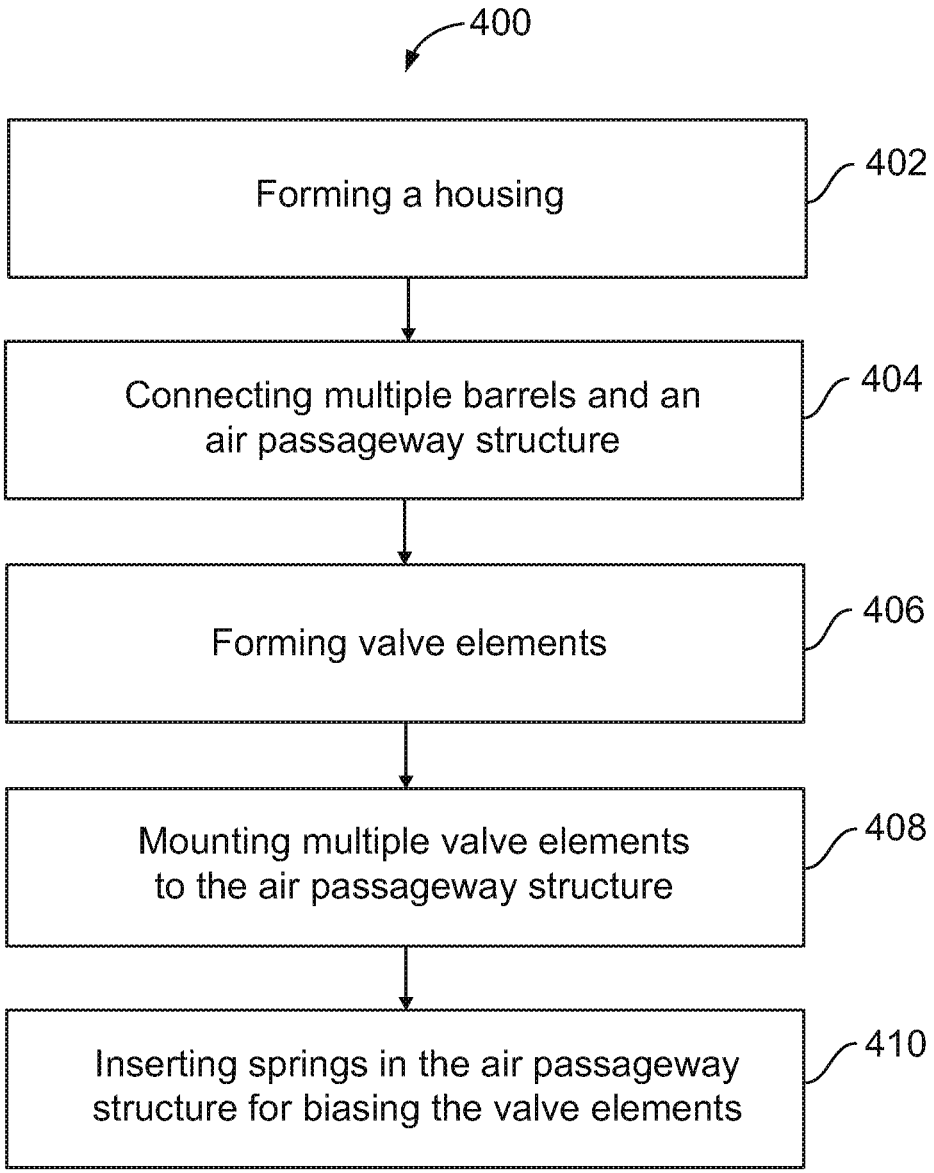
FIG. 16 is a flow diagram for a method of making a toy air gun with the air passageway structure and safety valves.

The connected series of valve element chambers may be increased by adding more chambers and associated inlets, outlets and transfer tubes until the compressed air of the system dissipates sufficient energy, often expressed as "pressure drop," that a dart can no longer be discharged with enough force to have play value. Stated another way, the practical limit for a blast of compressed air to cascade across an air passageway structure from chamber to chamber to a loaded barrel is reached when the compressed air does not have enough force to discharge a dart in the expected manner. Factors that may alter the available energy for dart discharge include the length and width of the cylinder and piston, the spring rate of the piston spring and the diameter of the channel. As mentioned above, the block may be linear as shown in FIG. 3, or appear to be cylindrical in which case an air path channel is generally circular as shown in FIGS. 14 and 15.

Movable in the chambers 180, 172, 164, 156 in the block 150 and somewhat in the barrels 104, 106, 108, 110 are a multiplicity or plurality of valve elements, such as the four valve elements 190, 192, 194, 196, respectively, one valve element associated with each of the barrels, for controlling movement of compressed air in the air path channel 152. Each valve element is movable in the block, through the spike plate and into the associated barrel, in a direction parallel to the longitudinal axis of the associated barrel, such as the longitudinal axis 198, FIG. 5, or along the longitudinal axis of the valve element itself, between a first, open, or rearward position and a second, closed, or forward position. The spike plate 182 includes two arcuate openings for each valve element, of which only one opening 199, FIG. 3, is shown (in hidden line) for the valve element 196, to allow passage of the arcuate arms of each valve element, the valve element being described below in relation to FIG. 4. The valve elements 190, 192, 194, illustrated in FIGS. 3, are in rearward, open positions because each corresponding barrel 104, 106, 108, respectively, has been loaded with a dart that has forced the associated valve elements rearward. The lower valve element 196 in FIG. 3, however, is illustrated in the forward closed position because the previously loaded dart 138 in the associated barrel 110 has been discharged and no longer holds the valve element 196 open. With the valve element 196 in the forward position, a blast of compressed air is no longer able to travel into the barrel 110. Instead, the compressed air is directed through the valve element 196 along the air path channel 152 toward the next valve element 194 and the barrel 108 because the barrel 108 is loaded with the dart 136. As explained below, the position of a valve element determines whether a blast of compressed air is directed to a dart in an associated barrel or toward a subsequent valve element in stages if no dart is present in an associated barrel. The succession of stages is referred to here a "cascade."

Figure 4:
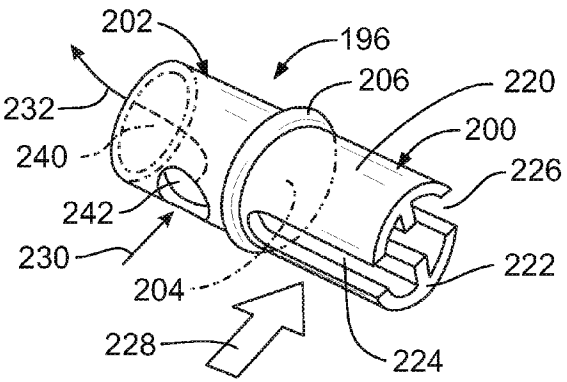
FIG. 4 is an isometric view of a valve element of the improved safety valve.

Each valve element has a generally cylindrical shape, such as the valve element 196, FIG. 4, with a front section 200, a rear section 202, an internal, non-perforated separation wall 204, and an outer O-ring 206. Each valve element is situated in a valve element chamber, such as the valve elements 196, 194, 192, 190 in the chambers 156, 164, 172, 180, respectively. Each of the plurality of valve elements is also associated with a biasing spring 210, 212, 214, 216, FIGS. 3, such as the spring 216 associated with the valve element 196, which is used to bias the associated valve element from the rearward position to the forward position. The front section 200, FIG. 4, of the valve element includes a specific configuration, such as two extending arcuate arms or segments 220, 222 separated by two slots 224, 226 that behave like ports to receive and pass a blast of compressed air, symbolized by an arrow 228, in an efficient and low pressure-drop manner. The chambers are slightly oversized where the valve elements travel, as shown in FIG. 3, however, when in the forward position, such as that taken by the valve element 196, the O-ring 206 seals the air path channel of the chamber 156 from the associated barrel 110 and directs the compressed air rearward through the rear section 202 of the valve element, as symbolized by the arrows 230, 232, FIG. 4, toward the first air outlet 158. When in a rearward position, such as that taken by the next valve element 194, FIG. 3, in line, the valve element's O-ring seals the rear portion of the chamber 164 so that compressed air is directed to the associated barrel 108 and the loaded dart 136. The spike plate 182 includes arcuate openings to enable the arcuate arms 220, 222 of the valve elements to move forward and rearward.

The rear section 202, FIG. 4, of the valve element 196 is tubular with an open back end 240 and a side port 242. The associated or corresponding biasing spring, such as the spring 216, is situated in the rear section 202 and serves to push the valve element forward toward the barrel. In the barrels before discharge are the darts 132, 134, 136, 138, FIG. 5, which are manually inserted by the user of the toy air gun. An open center of the dart is placed over a spike, such as the open center 244, FIG. 3, of the dart 136 is placed over the spike 245, and a ring shaped rear wall of the dart engages the corresponding valve element, such as the rear wall 246 of the dart 136, engaging the arms of the valve element 194, identical to the arms 220, 222 of the valve element 196, causing the dart to push the valve element rearward to the open position and compress the associated biasing spring, such as the spring 214. The rearward, open position of the valve element 194 in the chamber 164 may be compared to the forward, closed position of the valve element 196 in the chamber 156.

Friction between the outer surface of a dart and an inner surface of the barrel is sufficient to maintain the dart in the barrel, even when the air gun is turned vertically downward, and the associated valve element in the rearward position because under such conditions the biasing spring does not have sufficient force to overcome the friction and cause the valve element to move to the forward position. It is noted that when the valve element is in the rearward position, the O-ring blocks the air outlet, such as the O-ring 248, FIG. 3, of the valve element 194 blocks the second air outlet 166, and opens the way for a blast of compressed air to enter from the air inlet into the barrel, such as the second air inlet 162 and the barrel 108, and into the open center of a loaded dart, such as the dart 136 loaded in the barrel 108.

The block and barrels, the valve elements, the cylinder and piston, and the housing may all be made of a suitable plastic or plastics, as are well known to those of skill in the art. In the alternative, the gun apparatus may be made of metal or a combination of metal and plastic. Also in the alternative, instead of barrels, launch sites may be designed to discharge balls, disks or BBs.

Figure 6:
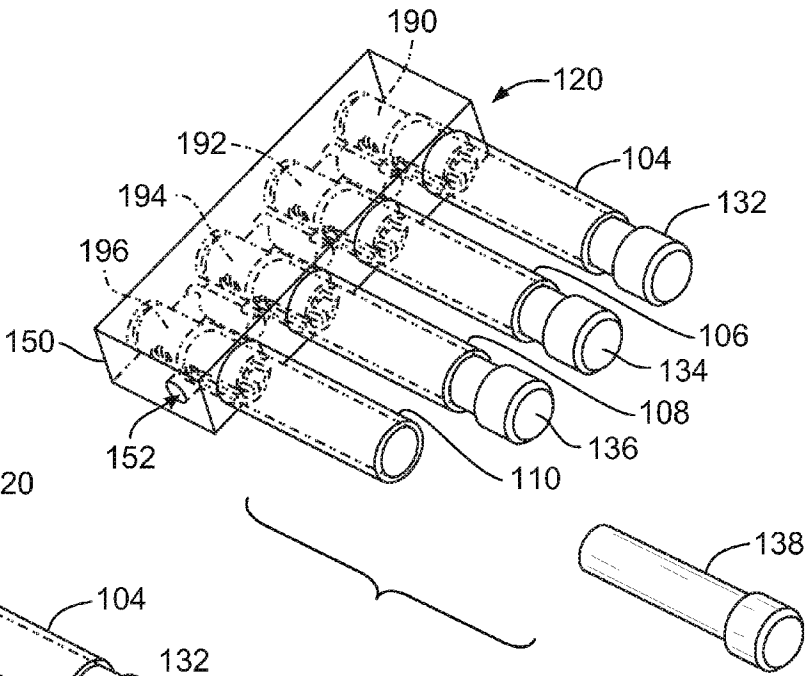
FIG. 6 is a diagrammatic isometric view of the air passageway structure shown in FIG. 5, with one projectile being discharged and the associated valve element remaining, momentarily, in the open rearward position.
Figure 5:
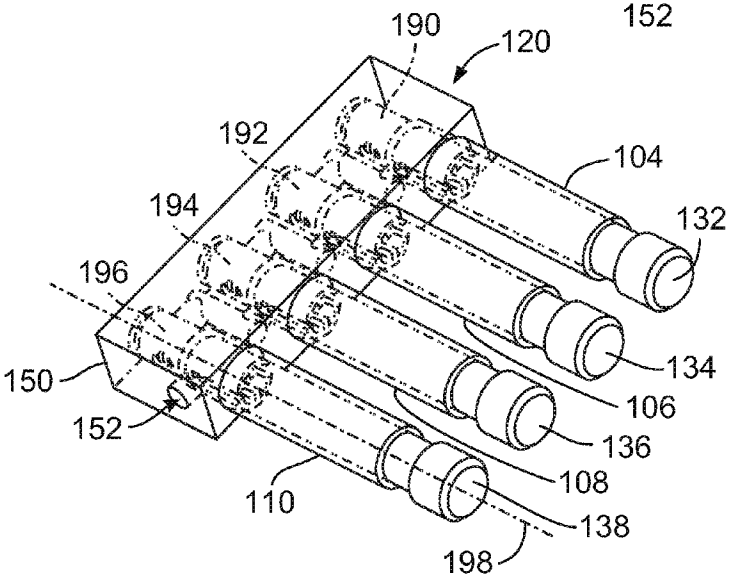
FIG. 5 is a diagrammatic isometric view of the air passageway structure, four barrels each loaded with a projectile, and four valve elements, with the valve elements in their open rearward positions.
Figure 7:
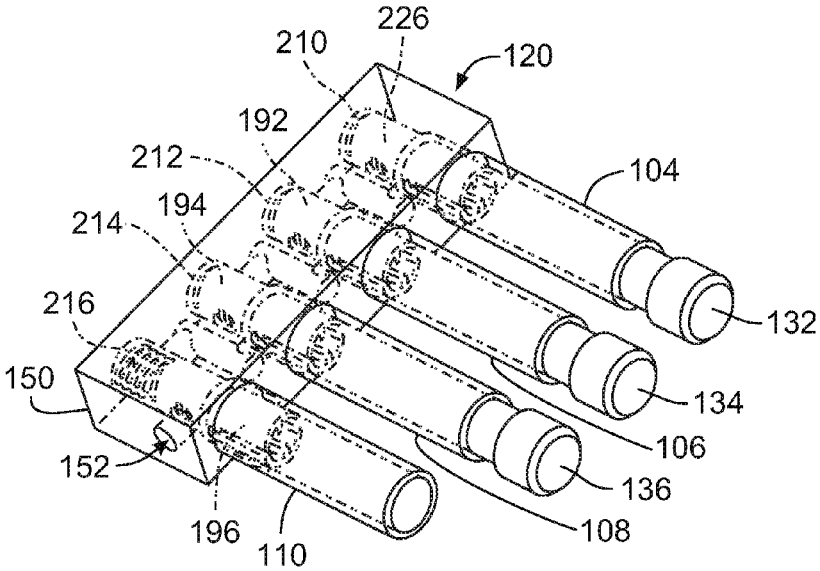
FIG. 7 is a diagrammatic isometric view of the air passageway structure shown in FIG. 6, with the valve element associated with the empty barrel in the closed forward position.

In operation, a blast of compressed air may be generated by a rapidly moving piston in a cylinder, and in the toy air gun illustrated, moved from the cylinder at the end of piston movement to the first air inlet 154, FIG. 5, through the slot 224, of the valve element 196 in a direction lateral to the longitudinal axis 198 of the barrel and lateral to the direction of movement of the valve element as shown by the arrow 228. Lateral or radial movement of a blast of compressed air into a valve element is different from the usual and inefficient axial movement of compressed air into and around a valve element so as to discharge a dart but also to dissipate energy in closing the valve element. In contrast, in the embodiments shown and described here, the blast of compressed air moving into the valve element 196 performs two functions, first, the compressed air discharges or fires the dart 138, FIG. 6, and second, the compressed air momentarily maintains pressure against a front surface 232, FIG. 3, of the valve element wall 204 to keep the valve element in the rearward position and prevents the valve element from immediately moving forward due to the biasing force of the spring 216. The momentary delay prevents undesirable dissipation of a blast of compressed air in directions other than against the dart. However, once the compressed air is dissipated in discharging the dart, the biasing spring is able to push the valve element 196 forward to the closed position shown in FIG. 7. The arrangement shown is very efficient because air enters the valve element from the side with little energy dissipation since the blast of compressed air is not used to close the valve element to block the barrel.

After the valve element 196 is moved to the forward position, the O-ring 206 and the valve element wall 204 blocks the barrel, and the valve element aligns the side port 242 of the rear section 202 of the valve element with the first air inlet 154. After again cocking the air gun and activating the trigger, the next blast of created compressed air passes through the first air inlet 154, through the port 242 of the rear section 202 and out the open back end 240 of the valve element 196. The high pressure of the compressed air against the rear surface 234 of the wall 204 and the O-ring 206 insures that the air flows rearward. The compressed air flows through the first valve element with a very low pressure-drop. Once the blast of compressed air exits the back end 240, the air flows to the first air outlet 158, along the first transfer path 160 and through the second air inlet 162 laterally to the slot of the next valve element 194. Thereafter, the blast of compressed air causes the dart 136 to be discharged. If the second barrel is empty, the valve element 194 is biased to the forward position and the compressed air flows through the valve element 194 cascading to the third air inlet 170 and the next valve element 192. If the next barrel 106 is loaded with a dart, the dart is discharged. If the barrel 106 is empty, the compressed air flows to the fourth air inlet 178 and the next valve element 190.

The just described cascading process may be repeated to connected valve elements in succession as long as sufficient pressure remains in the blast of compressed air to properly launch a dart. The low pressure drop of compressed air entering a valve element laterally and the low pressure drop of compressed air passing through the rear section of a valve element associated with an empty barrel meets the efficiency objectives of the present invention.

It is noted that throughout this description, words such as "forward", "rearward", "upward", "downward", "front", and "rear", "upper" and "lower", as well as like terms, refer to portions or elements of the gun apparatus as they are viewed in the drawings relative to other portions or in relationship to the positions of the apparatus as it will typically be held and moved during play when operated by a user, or to movements of elements based on the configurations illustrated.

Figure 8:
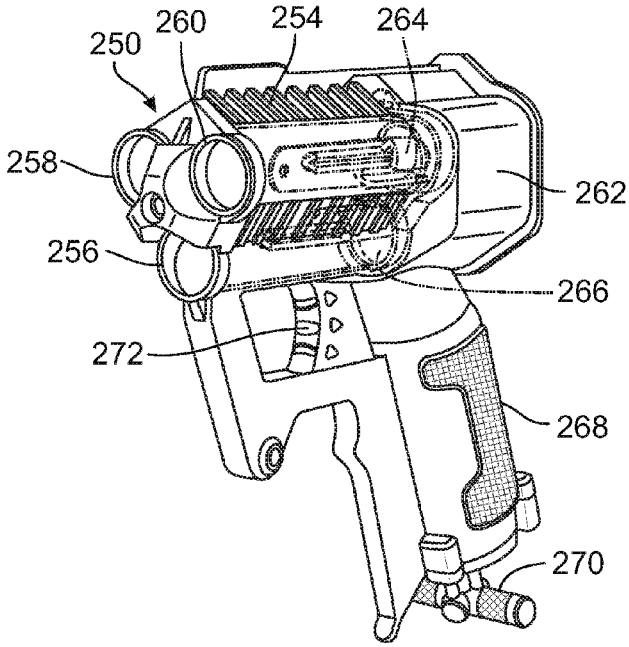
FIG. 8 is a diagrammatic isometric view of another embodiment of a toy gun apparatus with three barrels having a different form of air passageway structure.
Figure 9:
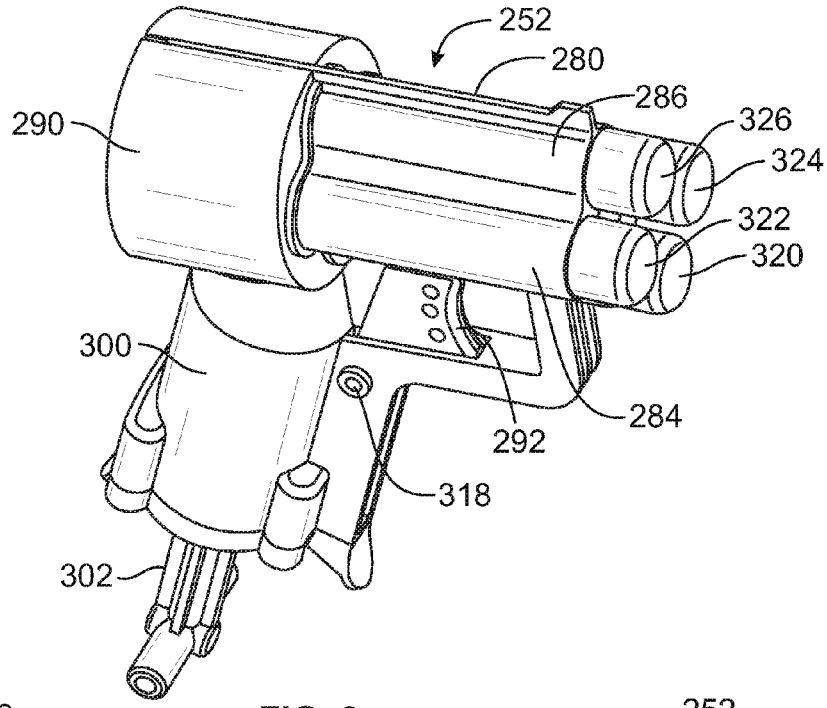
FIG. 9 is a diagrammatic isometric view of yet another embodiment of a toy air gun having four barrels.
Figure 10:
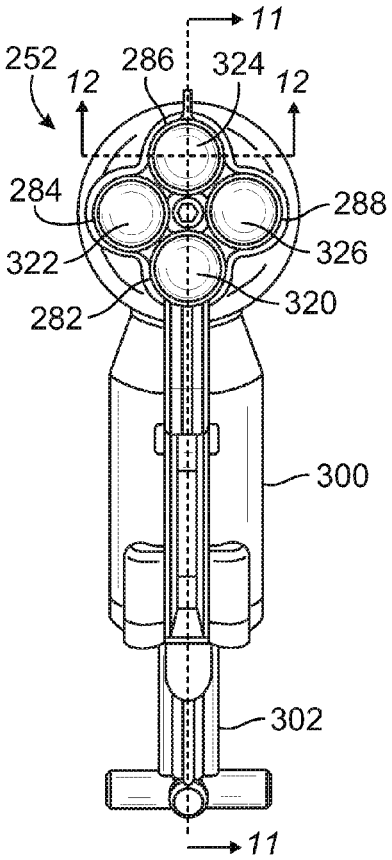
FIG. 10 is a diagrammatic front elevation view of the toy air gun shown in FIG. 9.

Two more toy gun embodiments 250, 252 are shown in FIGS. 8 and 9, respectively. The air gun 250 of FIG. 8 has a housing 254, three barrels 256, 258, 260, an air passageway structure 262, three valve elements, of which two valve elements 264, 266 are partially shown, and a grip 268. Within the grip 268 are a cylinder, piston, piston spring combination, like that shown in FIGS. 11, along with a cocking handle 270 connected to the piston at one end and the other end extending from the bottom of the grip 268. A pivotal trigger 272 is also mounted to the housing 254.

The other toy air gun 252 of FIG. 9 (and also shown in FIGS. 10-15), has a housing 280, four launch sites, such as four barrels 282, 284, 286, 288, an air passageway structure 290 operatively connected to each of the barrels, a trigger 292 mounted to the housing 280, and a cylinder 294, piston 296 and piston spring 298 combination in a grip 300. A handle 302 extends from the grip 300 and is used to cock the piston 296. Within the air passageway structure 290 are four valve elements, of which only two valve elements 304, 308 are shown. For reference purposes, a longitudinal axis 312, FIG. 12, of the barrel 286 is illustrated. The piston 296 may include a notch 314 to enable the piston to be held in place by a lower tab 316 of the trigger 292. The trigger 292 is pivotally connected to the housing with a pin 318. Darts 320, 322, 324, 326 are shown loaded in the barrels.

The air passageway structure 290 of the toy gun 252 is like the block and air path channel shown and described in relation to FIG. 3, except that the block and air path channel is arranged in a circular configuration as best shown in FIGS. 14 and 15. An air path channel 330 of the air passageway structure 290 includes a first inlet 332, FIGS. 11 and 15, a first valve element chamber 334, a first outlet 336, a first transfer tube 338, a second inlet 340, a second chamber 341, a second outlet 342, a second transfer tube 344, a third inlet 346, a third chamber 348, a third outlet 350, a third transfer tube 352, a fourth inlet 354, and a fourth chamber 355. An arrow 356, FIG. 11, symbolizes airflow.

Each of the safety valve elements is formed like the valve element shown and described in relation to FIG. 4. For example, the valve element 308, FIG. 12 has a generally cylindrical shape, with a front section 360, a rear section 362, a separation wall 364 and an O-ring 366. The front section 360 has two arcuate arms, of which only one arm 368 is shown, separated by compressed air receiving slots, and the rear section 362 includes a side port 374 and an open back end 376. A biasing spring 378 is located in the rear section 362.

Figure 13:
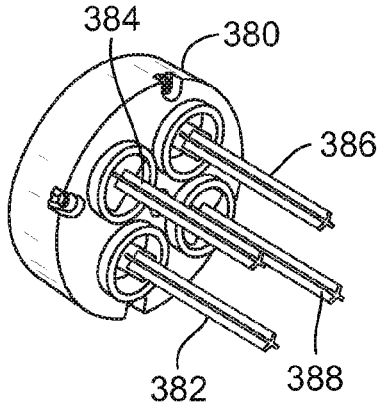
FIG. 13 is a diagrammatic isometric view of a spike plate with four spikes.

Located between the barrels 282, 284, 286, 288 and the air passageway structure 290 is a spike plate 380, FIG. 13.

Mounted to the spike plate 380 are four spikes or posts 382, 384, 386, 388. The arcuate arms of the valve element extend through the spike plate 380 so that contact with an inserted dart may be made. The spikes are part of the safety features of the toy guns because the spikes prevent loading of undesirable projectiles into the barrels.

At the upper portion of the cylinder 294, generated compressed air is directed lateral to the longitudinal axis of the barrels, and of the lower valve elements. Thus, a blast of compressed air need only flow between the arcuate arms, resulting in little energy loss or pressure drop. In operation, the toy gun 252 functions much like the toy gun 100, FIG. 1, in that after the user pulls the trigger 292, causing rotation about the pin 318 and removal of the tab 316 from the notch 314, the piston is released. The piston is able to snap upward under the influence of the spring 298 and compress the air ahead of the rapidly moving piston. The compressed air 356 flows through the front section of the valve element 304 to cause the dart 320 in the barrel 282 to be discharged. If the barrel is already empty the compressed air cascades to the next valve element to discharge the dart 322 in the next barrel 284. If the barrel 284 is also empty, the compressed air cascades to the next valve element 308 to discharge the dart 324 in the barrel 286. If the barrel 286 is also empty, the compressed air cascades to the next valve element to discharge the dart 326 in the barrel 288. Like with the air passageway structure 120, FIG. 3, the user may reload a barrel located earlier in the cascade sequence before all of the original darts located later in the sequence are discharged. For example, the barrel 282 may be reloaded after the darts in the barrels 282, 284 and 286 are discharged. The next blast of compressed air will again discharge the dart in the barrel 282 and, thereafter, the next blast of compressed air will cascade to the dart 326 in the barrel 288 because the barrels 284, 286 are empty. This feature allows a user to reload some or all of the barrels during a lull in play and not have to worry about which dart is going to be discharged with the next blast of compressed air. The air passageway structure will automatically direct the compressed air to the first loaded barrel in sequence.

Operation of the embodiment illustrated in FIGS. 9-15, is the same as that already described for the embodiment illustrated in FIGS. 1-7.

In the alternative, the housing may have a different shape from that shown, such as appearing to be more like a real gun, or having the design of a popular motif like STAR WARS™. The cylinder, piston and spring combination may be arranged in a more horizontal configuration, as would be the case with the air gun 100, FIG. 1. The specific configuration of the front section of the valve element may also be altered. For example, short posts may replace the arcuate wall segments, or some other configuration may be used to match a shape of a specific projectile. Also in the alternative, the housing may take the form of devices other than toy guns. For example, the housing may be a launcher which discharges soft foam rockets, balls or disks, or a bow for firing soft foam arrows. Instead of barrels, projectiles may be loaded into tubes. Instead of a trigger, the launch apparatus may include another type of actuator, such as a lever, and instead of a piston in cylinder combination, other generators of compressed air may be used, such as a bellows. The toy gun apparatus may also include, in the alternative, a projectile magazine, a cartridge, a cassette or a canister loaded with multiple projectiles to load the projectiles, sequentially, into a firing or discharge position.

The toy air guns and improved safety valves disclosed in detail above make efficient use of compressed air and allows for cascading in an easy, efficient and safe manner, and yet each air gun and safety valve described has a robust, but relatively simple structure, that may be produced at a reasonable cost.

The present invention also includes a method 400 for making the toy air guns, such as those shown in FIGS. 1, 8 and 9, including the steps of forming a housing 402, mounting a plurality of projectile barrels and an air passageway structure to the housing 404, the air passageway structure having a fixed air path channel, forming a plurality of valve elements 406, each valve element having a front section with a configuration for engaging projectiles with a specific shape and a side opening or slot for receiving compressed air, a rear section with side and rear openings, and a wall separating the front section from the rear section, mounting the multiple valve elements to the chambers in the air passageway structure 408 to be movable between forward and rearward positions and to receive compressed air in a direction lateral to the direction of movement of the valve elements, and inserting multiple springs in the air passageway structure 410, each spring for biasing a associated valve element in a forward direction.

From the foregoing, it can be seen that there has been provided a detailed disclosure of improved safety valves for toy air guns and a disclosure for the method of making the improved safety valves. While particular embodiments of the safety valves have been shown and described in detail, it will be obvious to those skilled in the art that changes and modifications may be made without departing from the present invention in its broader aspects. Therefore, the aim is to cover all such changes and modifications as fall within the true spirit and scope of the claimed invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. An air path and safety valve system for a toy launcher comprising:

a plurality of launch sites, each launch site being loadable with a projectile to be discharged;

an air passageway structure operatively connected in series to each of the plurality of launch sites to enable communication of a source of compressed air to each of the plurality of launch sites;

a plurality of valve elements, each valve element associated with one of the launch sites of the plurality of launch sites and being movable between two positions, a rearward position to enable compressed air to cause discharge of a loaded projectile from the launch site and a forward position to enable compressed air to bypass an unloaded launch site, the air passageway structure and the plurality of valve elements enabling a blast of compressed air to cascade from one or more valve elements of unloaded launch sites to a valve element of a loaded launch site; and a plurality of springs, each spring associated with a valve element of the plurality of valve elements for biasing the valve element from the rearward position to the forward position, and wherein loading a projectile in a launch site causes the associated valve element to move from the forward position to the rearward position.

2. The air path and safety valve system of claim 1, wherein: the air passageway structure includes a fixed air path channel.

3. The air path and safety valve system of claim 1, wherein:
the air passageway structure includes a plurality of chambers in the air path channel, one chamber for each of the plurality of valve elements.

4. The air path and safety valve system of claim 1, wherein:
after discharge of a projectile from a launch site, the associated valve element moves from the rearward position to the forward position.

5. The air path and safety valve system of claim 1, wherein:
each valve element is configured such that a blast of compressed air is delivered in a direction lateral to the direction of movement of the valve element.

6. The air path and safety valve system of claim 1, wherein:
each valve element includes a front section, a rear section and a non-perforated wall separating the front and rear sections.

7. The air path and safety valve system of claim 6, wherein:
the front section of each valve element includes a structure that a projectile with a predetermined configuration is able to move, and a side opening for a blast of compressed air to enter and discharge the projectile and to momentarily maintain the valve element in the rearward position.

8. The air path and safety valve system of claim 7, wherein:
the rear section of each valve element includes side and rear openings.

9. The air path and safety valve system of claim 1, wherein:
the air passageway structure includes a fixed air path channel, and a plurality of chambers in the air path channel, one chamber for each of the plurality of valve elements.

10. The air path and safety valve system of claim 9, wherein:
after discharge of a projectile from a launch site, the associated valve element moves from the rearward position to the forward position.

11. The air path and safety valve system of claim 10, wherein:
each valve element includes a front section, a rear section and a non-perforated wall separating the front and rear sections;
the front section of each valve element includes a structure that a projectile with a predetermined configuration is able to move, and a side opening for a blast of compressed air to enter and discharge the projectile and to momentarily maintain the valve element in the rearward position; and
the rear section of each valve element includes side and rear openings.

12. The air path and safety valve system of claim 11, including:
a spike plate; and
a plurality of spikes mounted to the spike plate; and wherein
portions of the front section extend through openings in the spike plate.

13. An air path and safety valve system for a toy air gun comprising:
a plurality of barrels, each barrel being structured to receive an inserted projectile to be discharged;
an air passageway structure having a fixed air path channel operatively connected in series to each of the plurality of barrels to enable communication of a source of compressed air;
a plurality of valve elements, each valve element associated with a barrel of the plurality of barrels and being movable in chambers of the air path channel between two positions, a rearward position to enable a blast of compressed air to cause discharge of an inserted projectile from the barrel and a forward position to enable compressed air to bypass the barrel when unloaded, wherein the air passageway structure and the plurality of valve elements enable a blast of compressed air to cascade from one or more valve element associated with unloaded barrels to a valve element associated with a loaded barrel; and
a plurality of springs, each spring associated with a valve element of the plurality of valve elements for biasing the valve element from the rearward position to the forward position, and wherein inserting a projectile in a barrel causes the associated valve element to move from the forward position to the rearward position.

14. The air path and safety valve system of claim 13, wherein:
upon receipt of a blast of the compressed air to the valve element of a loaded barrel, the associated valve element remains momentarily in the rearward position before moving to the forward position.

15. The air path and safety valve system of claim 14, wherein:
each valve element includes a front section, a rear section and a non-perforated wall separating the front and rear sections;
the front section of each valve element includes a structure that a projectile with a predetermined configuration is able to move, and a side opening for a blast of compressed air to enter and discharge the loaded projectile in the associated barrel and to momentarily maintain the valve element in the rearward position; and
the rear section of each valve element includes side and rear openings to facilitate a blast of compressed air to bypass an associated barrel.

16. A method for making a toy air gun comprising the steps of:
forming a housing;
connecting multiple projectile barrels to the housing;
mounting an air passageway structure in the housing in operative communication with each of the barrels in series, the air passageway structure having a fixed air path channel and multiple chambers;
forming multiple valve elements, each valve element having a front section with a configuration for engaging inserted projectiles having a predetermined shape and a side opening for receiving a blast of compressed air, a rear section with side and rear openings, and a non-perforated wall separating the front section from the rear section;
each valve element further being associated with a barrel of the multiple barrels and being movable between two positions, a rearward position to enable a blast of compressed air to cause discharge of an inserted projectile from the barrel and a forward position to enable compressed air to bypass the barrel when unloaded, wherein the air passageway structure and the multiple valve elements enable a blast of compressed air to cascade from one or more valve elements associated with unloaded barrels to a valve element associated with a loaded barrel; and
mounting each valve element of the multiple valve elements to a chamber in the air path channel of the air passageway structure such that each valve element is movable longitudinally between the forward and rearward positions, and each valve element of the multiple valve elements is able to receive a blast of compressed air in a direction lateral to the direction of movement of the valve element; and inserting multiple springs in the air passageway structure, each spring for biasing an associated valve element in a forward direction.

17. The method of claim 16, wherein:

each valve element is mounted to be movable from the forward position to the rearward position when a projectile is inserted into an associated barrel to engage the valve element.

18. The method of claim 17, wherein:

each valve element is formed to enable a blast of compressed air to momentarily maintain the valve element in the rearward position.

19. The method of claim 18, including the step of:

mounting each valve element of the multiple valve elements to enable a blast of compressed air to bypass an unloaded barrel by flowing through the side and rear openings of the rear section of the valve element.

20. The method of claim 19, including the step of:

mounting a source of compressed air to the housing in operative communication with the air path channel of the air passageway structure.

* * * * *